US008022684B2

(12) United States Patent
Bitting

(10) Patent No.: US 8,022,684 B2
(45) Date of Patent: Sep. 20, 2011

(54) EXTERNAL REGULATOR REFERENCE VOLTAGE GENERATOR CIRCUIT

(75) Inventor: Ricky F. Bitting, Fort Collins, CO (US)

(73) Assignee: LSI Corporation, Milpitas, CA (US)

( * ) Notice: Subject to any disclaimer, the term of this patent is extended or adjusted under 35 U.S.C. 154(b) by 325 days.

(21) Appl. No.: 12/418,400

(22) Filed: Apr. 3, 2009

(65) Prior Publication Data

US 2010/0253314 A1 Oct. 7, 2010

(51) Int. Cl.
*G05F 3/16* (2006.01)

(52) U.S. Cl. ..... 323/313

(58) Field of Classification Search ..... 323/273, 323/282, 312–314, 317, 351
See application file for complete search history.

(56) References Cited

U.S. PATENT DOCUMENTS

| | | | | |
|---|---|---|---|---|
| 7,642,759 | B2 * | 1/2010 | Dobkin | 323/269 |
| 7,652,455 | B2 * | 1/2010 | Demolli | 323/274 |
| 7,705,575 | B2 * | 4/2010 | Akyildiz et al. | 323/281 |
| 2005/0035813 | A1 * | 2/2005 | Xi | 327/539 |

* cited by examiner

*Primary Examiner* — Adolf Berhane
(74) *Attorney, Agent, or Firm* — William W. Cochran; Cochran Freund & Young LLC

(57) ABSTRACT

Disclosed is an external regulator reference voltage generator circuit that precisely controls the supply voltage applied to core logic to optimize the operational characteristics of the core logic 120 without using excessive power. An adaptive voltage and scaling optimization circuit 124 is used to detect the operating parameters of the core logic 120 and generate a voltage control signal to control a reference voltage regulator. The reference voltage regulator generates a regulator reference voltage in response to the voltage control signal that controls an external regulator which, in turn, generates the supply voltage.

10 Claims, 2 Drawing Sheets

EXTERNAL REGULATOR REFERENCE VOLTAGE GENERATOR CIRCUIT

BACKGROUND OF THE INVENTION

External voltage regulators are used to provide an external voltage to operate semiconductor devices. Different portions of semiconductor devices may require different voltages. For example, the I/O portion of a chip may require a different voltage than the voltage necessary to run core logic of the chip. In addition, the voltage level that is applied to the core logic of a chip may vary between chips, depending upon process variations during manufacture of the chip. The process of adaptive voltage scaling and optimization can be used to optimize operational speeds of the core of the chip, while minimizing power consumption by adjusting the voltage level being applied to the core logic. In that regard, it is advantageous to be able to accurately control the output voltage of a voltage regulator with a high degree of precision.

SUMMARY OF THE INVENTION

The present invention may therefore comprise a method of controlling a supply voltage that is applied to core logic in an integrated circuit comprising: providing an external voltage regulator that generates the supply voltage in response to a regulator reference voltage that is applied to a reference voltage input on the external voltage regulator; generating a bandgap reference current; applying the bandgap reference current to a variable resistor to produce the regulator reference voltage; applying the regulator reference voltage to the reference voltage input on the external voltage regulator; generating the supply voltage in the external regulator; applying the supply voltage to the core logic; determining operating parameters of the core logic using an adaptive voltage scaling and optimization circuit; generating a voltage control signal in the adaptive voltage scaling and optimization circuit based upon the operating parameters of the core logic; applying the voltage control signal to the variable resistor to adjust resistance of the variable resistor to adjust the regulator reference voltage.

The present invention may further comprise a system for controlling a voltage level of a supply voltage that is applied to core logic in a semiconductor comprising: an external voltage regulator that generates a supply voltage in response to a regulator reference voltage that is applied to a reference voltage input on the external voltage regulator; a reference voltage regulator comprising: a bandgap current generator that generates a precise bandgap current; a variable resistor that generates a variable regulator reference voltage; a driver amplifier that maintains the variable regulator reference voltage; an integrating capacitor that integrates the variable regulator reference voltage during start-up conditions; an output that generates the supply voltage and that is connected to the core logic so that the supply voltage is applied to the core logic; an adaptive voltage scaling and optimization circuit that is connected to the core logic to detect operating parameters of the core logic, and that generates a voltage control signal in response to the operating parameters of the core logic, the voltage control signal connected to the variable resistor so as to change the variable regulator reference voltage across the variable resistor.

DETAILED DESCRIPTION OF THE EMBODIMENTS

Figure 1:
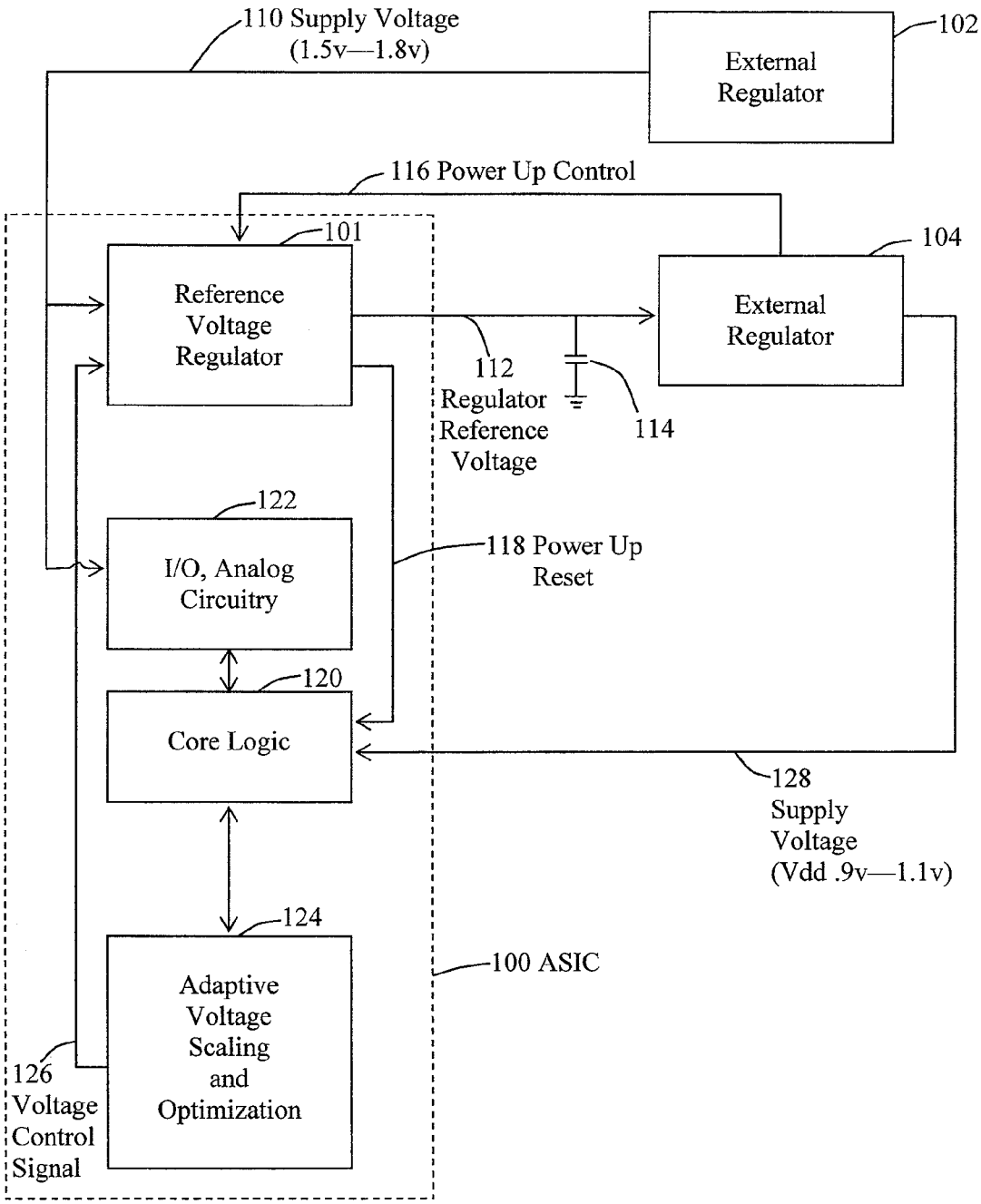
FIG. 1 is a schematic block diagram of one embodiment illustrating the application of the reference voltage regulator.

FIG. 1 is a schematic block diagram of an embodiment of a system that precisely regulates the supply voltage 128 that is applied to a core logic 120 in an ASIC 100. Process variations cause core logic in semiconductor chips, such as core logic 120, in application specific integrated circuits (ASICs), to operate at different speeds in accordance with the voltage applied to the core logic. Core logic of some chips can operate at full speed at lower voltages, such as 0.9 volts, while core logic of other chips may require a higher voltage, such as 1.1 volts, to operate at that same fast speed. Designs for worst case process results require that the highest possible supply voltage be applied to the core, which requires expensive packaging of the semiconductor to account for maximum heat dissipation. Rather than driving the core logic of all chips at the higher voltage, some chips can be driven at a lower voltage, which saves power and reduces heat in the device. Adaptive voltage scaling and optimization circuits use various algorithms for determining optimum voltages at which to run core logic. In accordance with the embodiment disclosed in FIG. 1, the voltage control signal 126, generated by the adaptive voltage scaling and optimization circuit 124, can be used to effectively control the output supply voltage of an external voltage regulator 104. In this manner, precisely controlled voltages can be used to drive core logic 120.

Alternative methods of controlling voltages have been less precise and are more expensive and awkward to use. For example, some voltage regulators operate with a digital input. The disadvantage of using such devices is that they typically require multiple pins to transmit a byte of information indicating the desired voltage level. Additional pins on semiconductors increase cost and the complexity of the chip. In addition, such devices normally do not have the resolution necessary to select the desired voltage output.

Some voltage regulators allow a user to employ external resistors to set the voltage output of the voltage regulator. Typically, the user provides a voltage divider circuit that generates a desired voltage at the output of the voltage regulator. The problem with this approach is that the resistors that provide the voltage divider circuit are placed in the user chip, which places the user chip in a feedback loop of the voltage regulator. Loop stability and transient responses in the feedback loop may affect the user chip.

Voltage regulators that have pins for inserting an external analog reference voltage provide a much more accurate way of generating a voltage that can be used to drive core logic. However, generation of a precise voltage to be applied to an external pin of a voltage regulator can also be problematic. For example, temperature differentials on chips may create differences between precisely generated bandgap currents and resistive elements used to create a precise reference voltage, resulting in variations of the reference voltage. Further, certain precautions must be taken in applying a reference voltage to an external regulator and circuitry on a user chip during start-up to prevent overloading of components.

Referring again to FIG. 1, external regulator 102 provides a supply voltage 110 in the range of 1.5 volts to 1.8 volts that is used to drive the input/output circuitry and other analog circuitry 122 in the ASIC 100. In addition, supply voltage 110 is also used to drive various analog components of the reference voltage regulator 101 that are also included in the ASIC 100. ASIC 100 also includes core logic 120 and adaptive voltage scaling and optimization circuitry (AVSO) 124 that is interconnected with the core logic 120. AVSO 124 generates a voltage control signal 126 that is used as a feedback control signal to control the voltage level of the regulator reference voltage 112. The adaptive voltage scaling and optimization circuit (AVSO) 124 detects the operating parameters of the core logic 124, such as the voltage level of the supply voltage 128 provided by the external regulator 104 and the operating speed of the core logic 120. If the core logic 120 is not operating at a speed within specified parameters for the core logic 120, the AVSO 124 will generate the voltage control signal 126 that increases the voltage level of the regulator reference voltage 112. The regulator reference voltage is applied to the external regulator 104 which, in turn, generates the supply voltage 128 that has a higher voltage level (at which worst case core logic is guaranteed to operate) is applied to the core logic 120. Iterative processes can be used to adjust the supply voltage 128 to operate the core logic 120 at a speed within the desired operational speed parameters for core logic 120. Similarly, if the voltage level of the supply voltage 128 is higher than it needs to be to operate the core logic 120 within the specifications for the operating speeds of the core logic 120, the AVSO 124 adjusts the voltage control signal 126 downwardly, which adjusts the reference voltage 112 and the supply voltage 128 downwardly. AVSO 124 can use various algorithms to adjust the regulator reference voltage 112 to the proper level.

As also shown in FIG. 1, external capacitor 114 integrates the reference voltage 112 during start-up, so as to adjust the slew rate of the regulator reference voltage 112 during start-up conditions, so that the external regulator 104 is not overdriven. Other devices and techniques are used during start-up to prevent overdriving of components and other problems that exist during start-up, as explained in more detail with respect to FIG. 2. For example, power-up control signal 116, generated by external regulator 104, controls the reference voltage regulator 101 during start-up.

Figure 2:
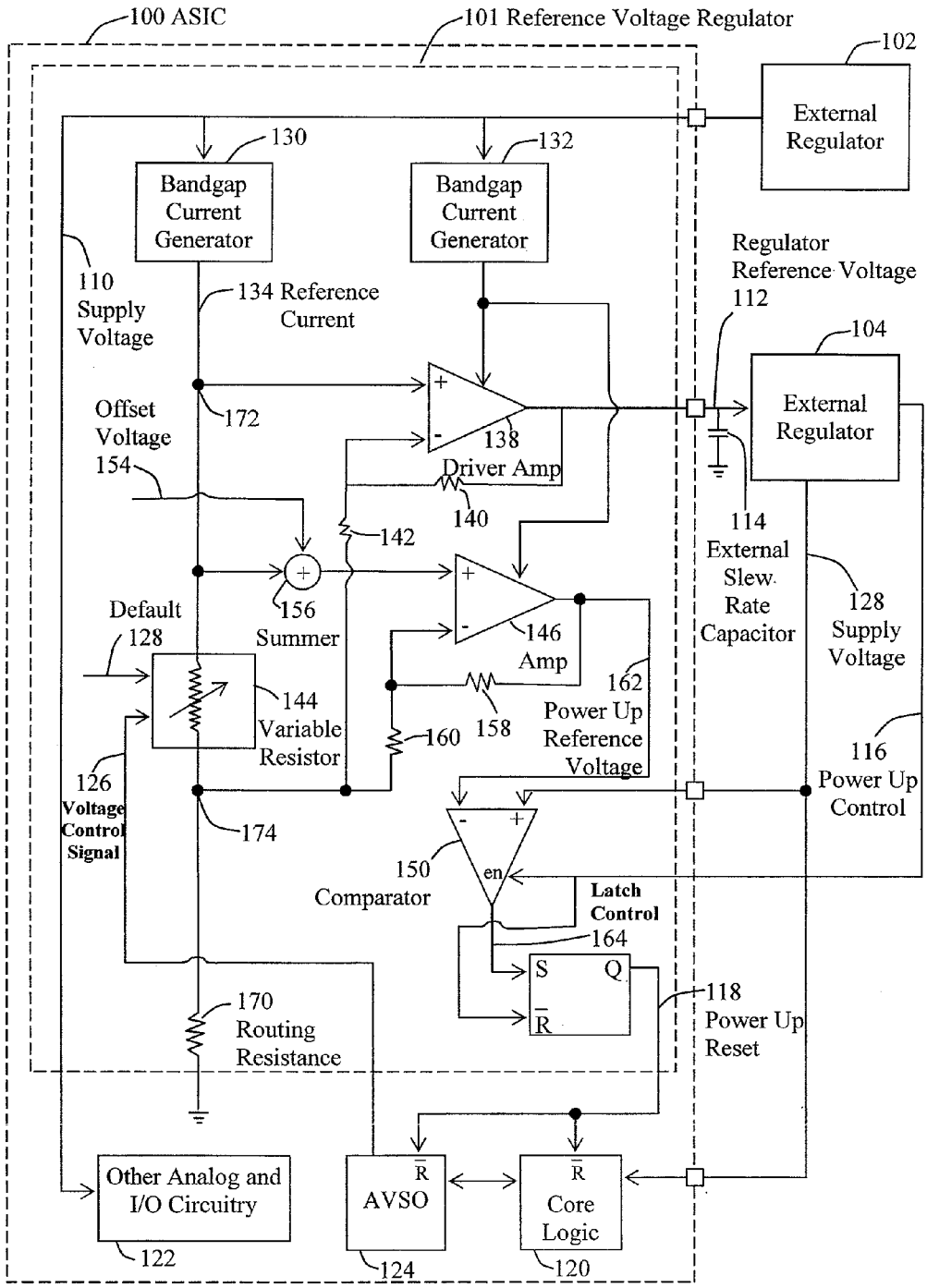
FIG. 2 is a schematic diagram of the embodiment of FIG. 1 illustrating an external regulator reference voltage generator circuit.

FIG. 2 is a schematic diagram of the embodiment illustrated in FIG. 1. As shown in FIG. 2, ASIC 100 includes a reference voltage regulator 101. External regulator 102 generates a supply voltage 110 that is used to power bandgap current generator 130 and bandgap current generator 132, in reference voltage regulator 101, and other analog and input/output (I/O) circuitry 122 in ASIC 100. Typically, the voltage level of the supply voltage 110 is in the range of 1.5 volts to 1.8 volts. Voltage regulator 104 generates a supply voltage 128 that is used to power the core logic 120 that is in the range of 0.9 volts to 1.2 volts. External regulator 104 generates the supply voltage 128 based upon the voltage level of the regulator reference voltage 112 that is applied to a reference voltage input pin of the external regulator 104. Bandgap current generator 130 generates a reference current 134, which is a precisely controlled current that is generated using bandgap techniques. For example, reference current 134 may be in the range of 25 microamps. The reference current 134 is applied to variable resistor 144, which creates a voltage drop across the variable resistor 144 that is proportional to the resistance of the variable resistor 144. During start-up, a default signal 129 is applied to the variable resistor 144 so that a default resistance is used during start-up. A voltage control signal 126 generated by AVSO 124 is used during other times to control the resistance of the variable resistor 144 which controls the voltage drop across variable resistor 144. The voltage drop across the variable resistor 144 is applied to the positive and minus inputs of driver amp 138, which produces the regulator reference voltage 112 that is based upon the voltage drop across variable resistor 144. The regulator reference voltage 112 is equal to $1+R_2/R_1$, where $R_1$ is equal to the resistance of resistor 142 and $R_2$ is equal to the resistance of resistor 140. As set forth above, external slew rate capacitor 114 controls the slew rate of the regulator reference voltage 112, so that the external regulator 104 is not overdriven during start-up conditions.

As also illustrated in FIG. 2, a separate reference voltage is generated by amplifier 146, which is referred to as power-up reference voltage 162. During the layout of the ASIC 100, resistor 140 is laid out adjacent to resistor 142 and has the same size and width. Similarly, resistor 158 is laid out adjacent to resistor 160 and has the same size and width. In this fashion, changes in the regulator reference voltage 112 will be tracked by the power-up reference voltage 162. Similarly, resistors in the bandgap current generator 130 are laid out adjacent to resistors 144 and have a similar size and width, so that temperature and process variations will track proportionally in bandgap generators 130 and resistor 144. Offset voltage 154 is applied to a summer circuit 156 that ensures that the comparator 150 always trips during power-up.

As also shown in FIG. 2, the power-up reference voltage signal 162 is applied to a comparator 150 that compares the power-up reference voltage 162 with the supply voltage 128. When the ASIC 100 is fully powered-up, the power-up reference voltage 162 should be the same as the supply voltage 128. Comparator 150 is enabled by a power-up control signal 116 generated by external regulator 104. The power-up control signal 116 is also applied to the reset of latch 168. The latch control signal 164, generated by the comparator 150, is applied to the set control of latch 168. Latch 168 generates a power-up reset signal 118 that is applied to AVSO 124 and core logic 120 that holds the AVSO 124 and core logic 120 in a reset state until the ASIC 100 is completely powered-up and the supply voltage 128 has reached an operating voltage level. In this fashion, AVSO 124 and core logic 120 are not turned on until the supply voltage 128, applied to core logic 120, has reached an operating voltage level. Routing resistance 170 comprises the resistance of the leads in the reference voltage regulator 101. Nodes 172, 174 are located proximate to the variable resistor 144 so that routing resistance, such as the routing resistance 170 does not play a factor in the resistance provided by variable resistor 144.

Hence, the system illustrated in the embodiment disclosed in FIG. 1 and FIG. 2 is capable of generating a precise supply voltage that can be controlled by an AVSO circuit, such as AVSO 124, to operate core logic 120 at a voltage that is capable of allowing the core logic 120 to operate at optimum speeds without applying excessive power to the core logic 120. This is accomplished in a precise manner by using bandgap current generators and laying out components on ASIC 100 to account for temperature and process variations in the semiconductor material. Further, power-up problems (high currents due to fast voltage changes across capacitors) are handled by controlling the slew rate of the regulator reference voltage 112 and holding the AVSO 124 and the core logic 120 in a reset state until the supply voltage 128 reaches an operating voltage.

The foregoing description of the invention has been presented for purposes of illustration and description. It is not intended to be exhaustive or to limit the invention to the precise form disclosed, and other modifications and variations may be possible in light of the above teachings. The embodiment was chosen and described in order to best explain the principles of the invention and its practical application to thereby enable others skilled in the art to best utilize the invention in various embodiments and various modifications as are suited to the particular use contemplated. It is intended that the appended claims be construed to include other alternative embodiments of the invention except insofar as limited by the prior art.

What is claimed is:

1. A method of controlling a supply voltage that is applied to core logic in an integrated circuit comprising:

providing an external voltage regulator that generates said supply voltage in response to a regulator reference voltage that is applied to a reference voltage input on said external voltage regulator;

generating a bandgap reference current;

applying said bandgap reference current to a variable resistor to produce said regulator reference voltage;

applying said regulator reference voltage to said reference voltage input on said external voltage regulator;

generating said supply voltage in said external regulator;

applying said supply voltage to said core logic;

determining operating parameters of said core logic using an adaptive voltage scaling and optimization circuit;

generating a voltage control signal in said adaptive voltage scaling and optimization circuit based upon said operating parameters of said core logic;

applying said voltage control signal to said variable resistor to adjust resistance of said variable resistor to adjust said regulator reference voltage.

2. The method of claim 1 further comprising:

providing an integrating capacitor that integrates said regulator reference voltage to prevent said external voltage regulator from being overdriven during startup.

3. The method of claim 2 further comprising:

amplifying said regulator reference voltage produced by a voltage drop across said variable resistor prior to applying said regulator reference voltage to said reference voltage input on said external voltage regulator.

4. The method of claim 3 further comprising:

providing a latch that maintains said core logic in reset mode until said supply voltage reaches an operating level.

5. The method of claim 4 further comprising:

generating a power-up reference voltage by applying said bandgap reference current to said variable resistor;

amplifying said power-up reference voltage;

comparing said power-up reference voltage with said supply voltage in a power-up voltage reference comparator to generate a latch control signal;

applying said latch control signal to said latch.

6. The method of claim 5 further comprising:

generating a power-up control signal from said external regulator;

enabling said power-up voltage reference comparator with said power-up control signal.

7. A system for controlling a voltage level of a supply voltage that is applied to core logic in a semiconductor comprising:

an external voltage regulator that generates a supply voltage in response to a regulator reference voltage that is applied to a reference voltage input on said external voltage regulator;

a reference voltage regulator comprising:

a bandgap current generator that generates a precise bandgap current;

a variable resistor that generates a variable regulator reference voltage;

a driver amplifier that maintains said variable regulator reference voltage;

an integrating capacitor that integrates said variable regulator reference voltage during start-up conditions;

an output that generates said supply voltage and that is connected to said core logic so that said supply voltage is applied to said core logic;

an adaptive voltage scaling and optimization circuit that is connected to said core logic to detect operating parameters of said core logic, and that generates a voltage control signal in response to said operating parameters of said core logic, said voltage control signal connected to said variable resistor so as to change said variable regulator reference voltage across said variable resistor.

8. The system of claim 7 further comprising:

an amplifier that is connected to said variable resistor that maintains said regulator reference voltage that is applied to said external voltage regulator.

9. The system of claim 8 wherein said reference voltage regulator further comprises:

a latch that maintains said core logic in reset mode until said supply voltage reaches an operating level.

10. The system of claim 9 wherein said reference voltage regulator further comprises:

an additional amplifier that is connected to said variable resistor that maintains a power-up reference voltage;

a comparator that compares said power-up reference voltage with said supply voltage to generate a latch control signal;

a latch that holds said core logic in a reset mode in response to said latch control signal until said supply voltage reaches said operating level.

* * * * *